US006414469B1

(12) United States Patent
Zhou et al.

(10) Patent No.: US 6,414,469 B1
(45) Date of Patent: Jul. 2, 2002

(54) CURRENT SENSING AND CURRENT SHARING

(75) Inventors: Xunwei Zhou, Fremont, CA (US); Fred C. Lee, Blacksburg, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 0 days.

(21) Appl. No.: 09/734,697

(22) Filed: Dec. 13, 2000

Related U.S. Application Data

(63) Continuation of application No. 09/448,297, filed on Nov. 24, 1999, now abandoned
(60) Provisional application No. 60/110,694, filed on Dec. 3, 1998.

(51) Int. Cl.[7] ..... G05F 1/40
(52) U.S. Cl. ..... 323/272; 323/282
(58) Field of Search ..... 323/272, 271, 323/280, 282, 284, 285, 268

(56) References Cited

U.S. PATENT DOCUMENTS

| | | | | |
|---|---|---|---|---|
| 4,628,433 A | | 12/1986 | Notohamiprodjo | |
| 5,477,132 A | * | 12/1995 | Canter et al. | 323/282 |
| 5,808,453 A | | 9/1998 | Lee et al. | |
| 6,023,154 A | * | 2/2000 | Martinez | 323/272 |

OTHER PUBLICATIONS

F. Lee et al., "Power Management for Future Generation of Processors", Intel Research Council, Thursday, Sep. 11, 1997.

* cited by examiner

*Primary Examiner*—Rajnikant B. Patel
(74) *Attorney, Agent, or Firm*—Whitham, Curtis & Christofferson P.C.

(57) ABSTRACT

An interleaved small-inductance buck voltage regulator (VRM) converter with the novel current sensing and sharing technology significantly improves transient response with size minimization. Specifically, two or more buck VRM modules are interleaved or connected in parallel. The resultant current waveform has a fast transient response but with reduced ripples since the ripples in the individual modules mathematically cancel one another. The result is a smooth output current waveform having spikes within an acceptable tolerance limits when for example the load increases due to a connected processor changing from "sleep" to "active" mode. A novel current sensing and sharing scheme between the individual VRMs is implemented using an RC network in each module to detect inductor current for that module. Good current sharing result can be easily achieved. Unlike peak current mode control and average current mode control, with this technology, the converter still has low output impedance and fast transient response. As a result, the VRM can be very cost-effective, high power density, high efficiency and have good transient performance.

14 Claims, 11 Drawing Sheets

CURRENT SENSING AND CURRENT SHARING

CROSS REFERENCE TO RELATED APPLICATION

This application is a continuation of application Ser. No. 09/448,297, filed on Nov. 24, 1999, now abandoned, which claims priority to provisional application Serial No. 60/110,694, filed on Dec. 3, 1998, both of which are herein incorporated by reference.

BACKGROUND OF THE INVENTION

1. Field of the Invention

The present invention generally relates to voltage regulator modules (VRMs) and, more particularly, to quasi-square-wave (QSW) interleaved buck converters with current sensing and sharing.

2. Decription of the Prior Art

An evolution in microprocessor technology poses new challenges for supplying power to these devices. The evolution began when the high-performance PENTIUM processor was driven by a non-standard, less-than 5V power supply, instead of drawing its power from the 5V plane on the system board. In order to meet faster and more efficient data processing demands, modem microprocessors are being designed with lower voltage requirements. The processor supply voltage in future generation processors will decrease from 3.3V to 1.1V~1.8V. Meanwhile, since more devices are being packed on a single processor chip and the processors are operating at higher operating frequencies, microprocessors require more aggressive power management. Future generation processor current draw is predicted to increase from 13 A to between 30 A–50 A. These higher currents in turn require special power supplies, known as voltage regulator modules (VRMs), to provide lower voltages with higher current capability for the microprocessors.

TABLE 1

Specifications for current and future VRM

| | Current | Future |
|---|---|---|
| Output Voltage: | 2.1~3.5 V | 1~3 V |
| Load Current: | 0.3~13 A | 1~50 A |
| Output Voltage Tolerance: | ±5% | ±2% |
| Current Slew at decoupling Capacitors | 1 A/nS* | 5 A/ns |

*Current slew rate at today's VRM output is 30 A/uS

Table 1 shows the specifications for current and future VRMs. As the speed of the processor grows, the dynamic loading, and hence the slew rate, of the VRM increases. The current slew rate measures the maximum rate of change current draw based on dynamic loading and voltage across the output terminals of the power supply. These slew rates represent a severe problem for large load changes that are usually encountered in power management systems when the systems shift from sleep mode to active mode and vice versa. In this case, the parasitic impedance of the power supply connection to the load and the parasitic elements of capacitors have a dramatic effect on VRM voltage. Future microprocessors are expected to exhibit higher current slew (from 1 A/nS to 8 A/ns) and larger current draw. Moreover, the total voltage tolerance will become much tighter. Presently, the voltage tolerance is 5% (for 3.3V VRM output, the voltage deviation can be ±165 mV). In the future, the total voltage tolerance will be 2% (for 1.1V VRM output, the voltage deviation can only be ±33 mV). All these requirements pose serious design challenges.

Most of today's VRMs use conventional buck or synchronous rectifier buck topology. In the future for low-voltage and high dynamic loading applications, the limitations of these topologies become very clear. In order to maintain the voltage regulation of future requirements during the transient, more output filter capacitors and decoupling capacitors will be needed. However, the space of the VRM and motherboard are very limited, increasing capacitors is an impractical approach. To meet future specifications, novel VRM topologies are required.

FIG. 1 shows the conventional buck circuit, which is the most cost-effective approach. Usually, Schottky diodes are used as the rectifier. The upper MOSFET transfers energy from the input and the lower rectifier conducts the inductor current. The control regulates the output voltage by modulating the conduction interval of the upper MOSFET. FIG. 2 shows a conventional synchronous rectifier buck circuit. This topology increases the efficiency of low output voltage DC-to-DC converters by replacing the rectifier with a MOSFET. Its control and transient response are similar to those of a conventional buck converter.

During the transient, the buck and the synchronous buck exhibit three spikes in the voltage drop. FIG. 3 shows the transient response of these topologies illustrating the first, second, and third spikes. FIG. 4 shows the practical VRM load model (processor model) which illustrates the parasitic loops that cause these spikes. The first spike is dominated by loop F2, the second spike is dominated by loop F3, and the third spike is dominated by loop F4. The limitation of these two topologies comes from their large output filter inductance. During the transient, this large inductor limits the energy transfer speed, therefore almost all the energy is provided by capacitors. For future microprocessor applications (Table 1), with its higher load current and tighter voltage tolerance requirements, more decoupling capacitors will be needed to reduce the second spike, and more output bulk capacitors will be needed to reduce the third spike (capacitors are used to reduce equivalent series resistance (ESR) and equivalent series inductance (ESL) and to provide energy.). As a result, FIG. 5 shows that in order to meet future specifications, about twenty-three (23) times the decoupling capacitors are needed and three (3) times the bulk capacitors are needed when compared with the capacitors used for today's requirement. However, in the future, limited space will be important to power devices that need to be used in parallel to reduce the conduction loss in low-voltage high-current converters to satisfy the efficiency requirements of the VRM. The need for a large quantity of capacitors makes the conventional VRMs impractical and expensive for future microprocessors.

SUMMARY OF THE INVENTION

It is therefore an object of the present invention to provide a dc-dc converter for a power supply which is capable of a high current slew.

It is yet another object of the present invention to provide a dc-dc converter which supplies with a fast transient response required when, for example, a load processor changes from sleep mode to active mode.

According to the invention, an interleaved small-inductance buck VRM converter with the novel current sensing and sharing technology to significantly improve the transient response with size minimization. Specifically, two or more buck VRM modules are interleaved or connected in parallel. The resultant current waveform has a fast transient response but with reduced ripples since the ripples in the individual modules mathematically cancel one another. The result is a smooth output current waveform having spikes within an acceptable tolerance limits when for example the load increases due to a connected processor changing from "sleep" to "active" mode. A novel current sensing and sharing scheme between the individual VRMs is implemented using an RC network in each module to detect inductor current for that module. Good current sharing result can be easily achieved. Unlike peak current mode control and average current mode control, with this technology, the converter still has low output impedance and fast transient response. As a result, the VRM can be very cost-effective, high power density, high efficiency and have good transient performance.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
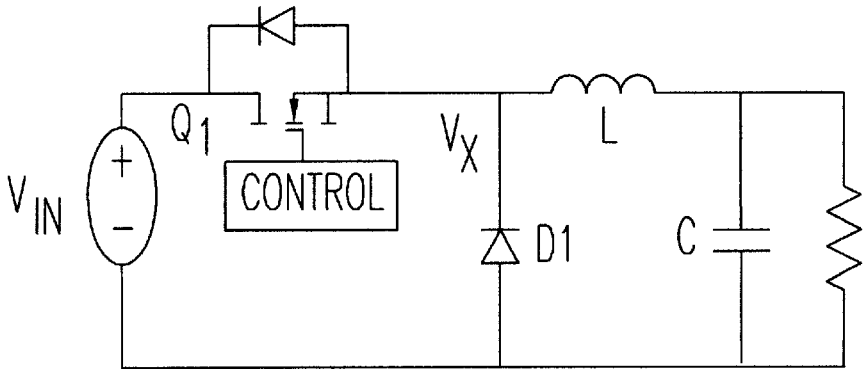
FIG.1 (PRIOR ART)
FIG. 1 is conventional buck converter VRM.
Figure 2:
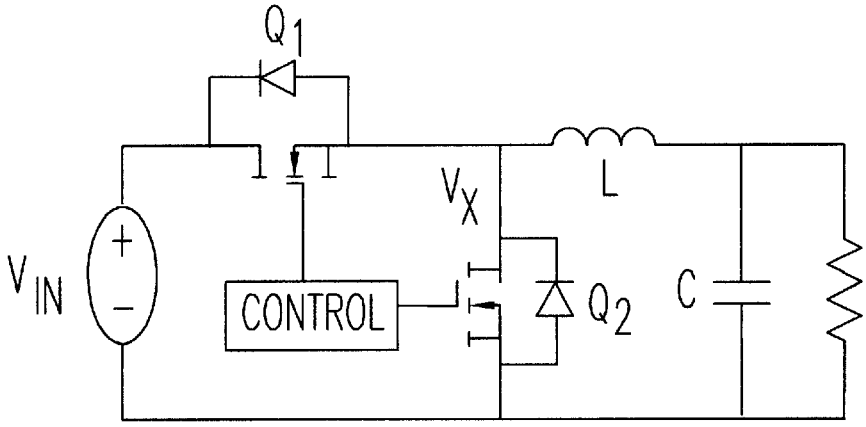
FIG.2 (PRIOR ART)
FIG. 2 is a conventional synchronous buck rectifier VRM.
Figure 3:
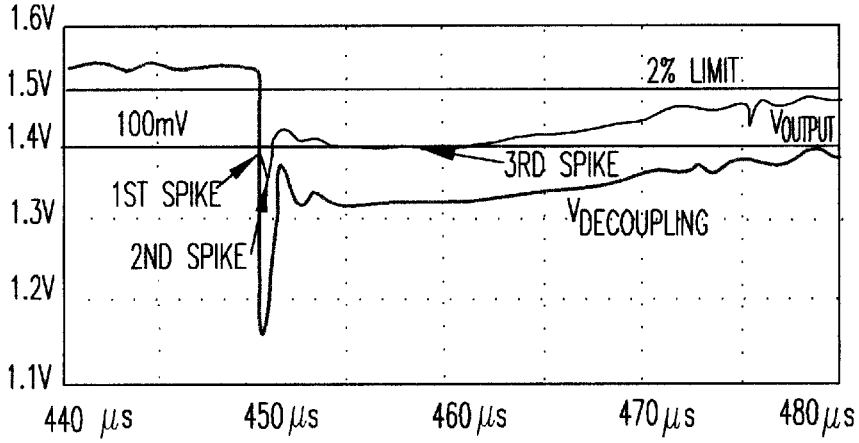
FIG.3 (PRIOR ART)
FIG. 3 is the transient response for conventional VRMs.
Figure 4:
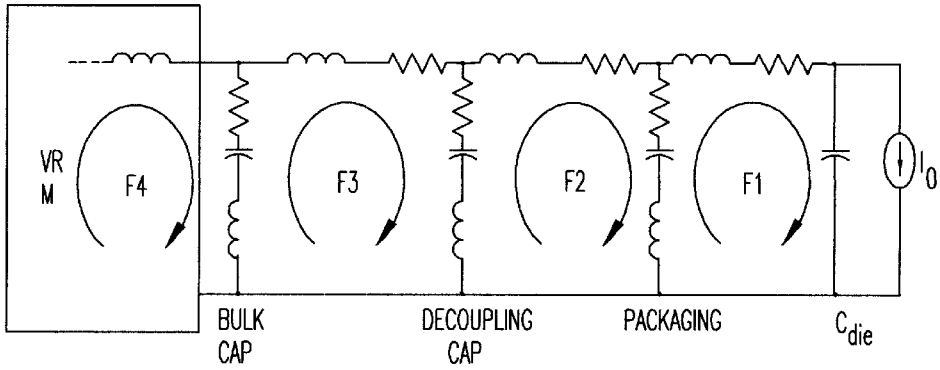
FIG.4 (PRIOR ART)
FIG. 4 is a practical VRM load model.
Figure 5:
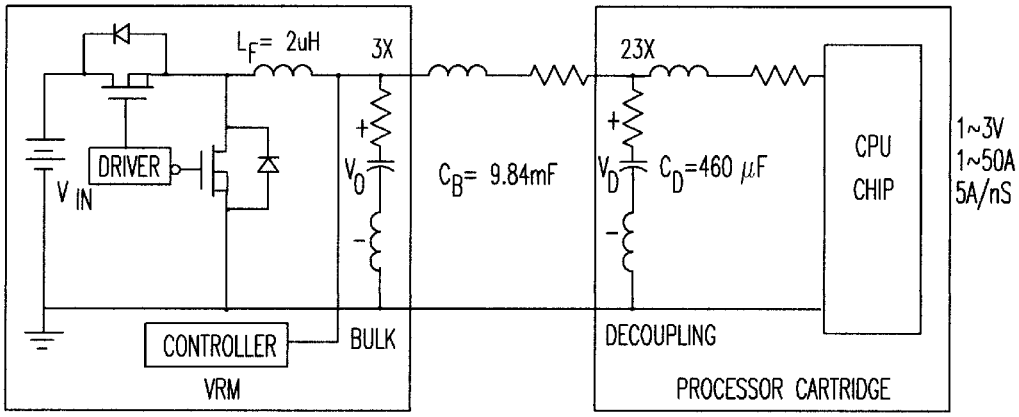
FIG. 5 is a diagram showing the decopling capacitors required for a conventional VRM.
Figure 6:
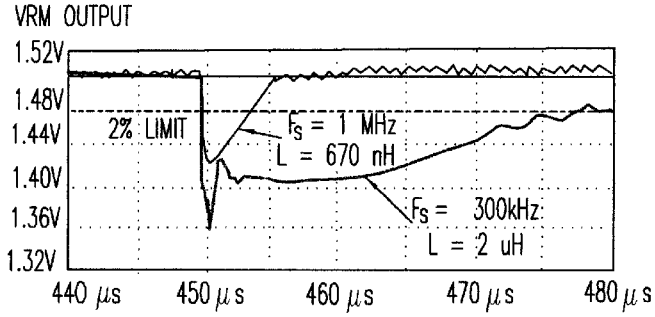
FIG.6 (PRIOR ART)
FIG. 6 is a conventional VRM transient response at current lower frequency processor speeds.
Figure 7:
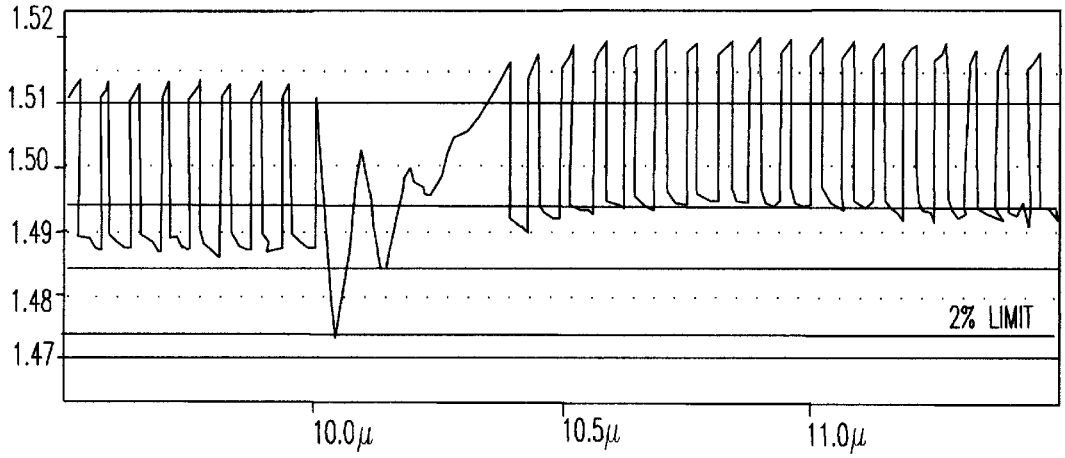
FIG.7 (PRIOR ART)
FIG. 7 is a conventional VRM transient response at future higher frequency processor speeds without increased output filter capacitance.

A key factor in VRM transient response improvement and filter capacitance reduction is to reducing the output inductance. There are several approaches to decrease the inductance. One is to increase switching frequency. FIG. 6 and 7 show the VRM transient response. As shown in FIG. 6, by increasing the switching frequency, VRM can keep inductor current in continuous current mode while using smaller inductance. As shown in FIG. 7, if the output capacitance remains the same, the VRM switching frequency has to be increased to 16 MHZ. At such a high switching frequency, the VRM efficiency will be very low.

Figure 8A:
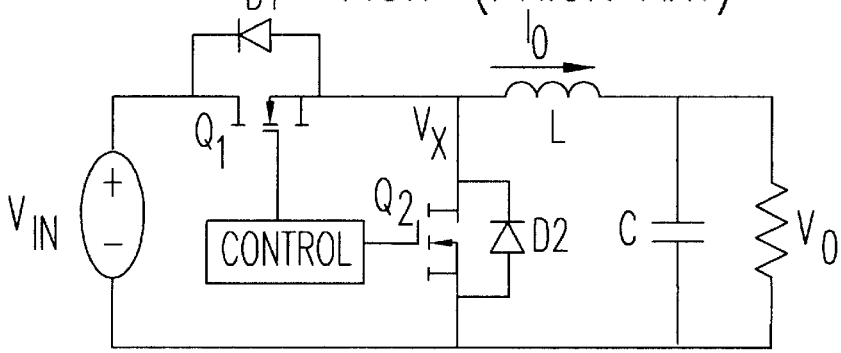
FIGS. 8A–B are a quasi-square-wave (QSW) topology and timing diagram, respectively.
Figure 8B:
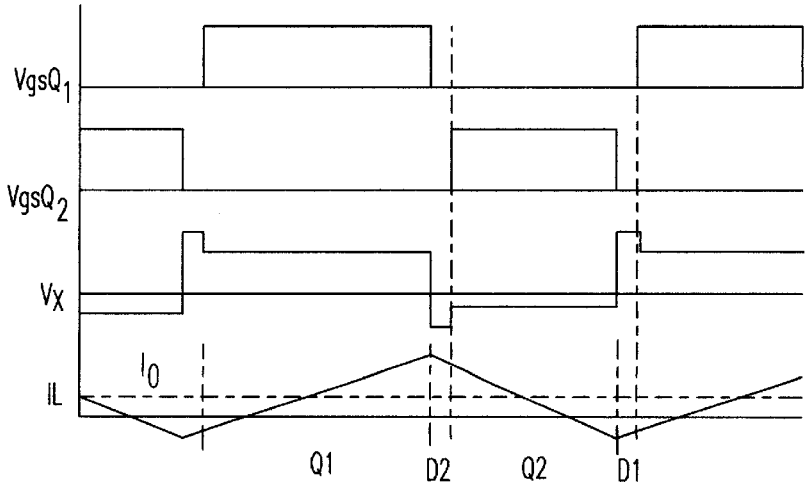

The buck converter with small inductance, like quasi-square-wave (QSW) buck converter, can have fast transient response without increasing switching frequency. FIGS. 8A–B shows the QSW circuit. The QSW topology keeps the VRM output inductor current touching zero in both sleep mode and active mode. The peak-peak value of the inductor current is 2 times the load current. Its inductor is smaller than or close to $Vo*(1-D)/(2*Io*fs)$. For a 13A load and 300 kHz switching frequency VRM, it needs only 160 nH inductor instead of 2~4 $\mu$H used in conventional VRMs. Due to the small inductor, both Q1 and Q2 of QSW VRM turns on at zero voltage. Before Q2 turns on, current flows in the positive direction. D2 conducts at first, then Q2 turns on at zero voltage. Before Q2 turns off, inductor current becomes negative. After Q2 turns off and before Q1 turns on, D1 turns on. Then Q1 turns on at zero voltage. However, as shown in FIG. 8B, the output current experiences an undesirable ripple effect.

Figure 9A:
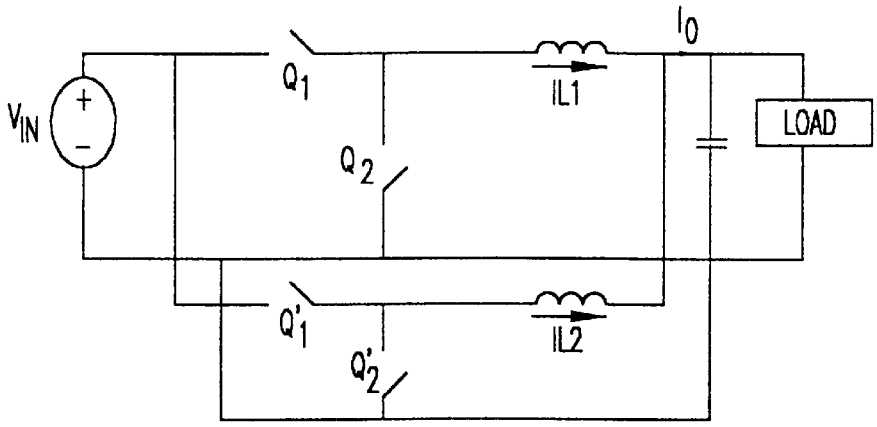
FIG. 9A is a two-module interleaved QSW VRM, according to the present invention.
Figure 9B:
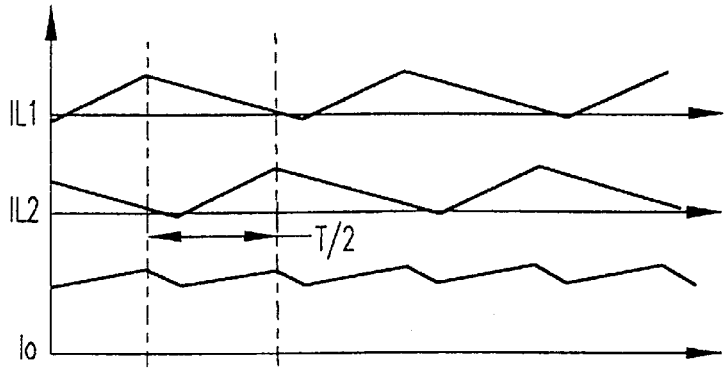
FIG. 9B is a timing diagram showing the output rippling canceling effect of the two-module interleaved QSW VRM.

The output current of QSW topology is large. As a result, large output capacitance is needed to reduce steady state voltage ripple. In order to meet both the steady state and transient requirements, a novel VRM topology, interleaved QSW VRM, is proposed. As shown in FIGS. 9A–B, the interleaved QSW topology naturally cancels the output current ripple and keeps the fast transient response characteristics of the QSW topology.

Referring to FIG. 9A there is shown a two-module interleaved QSW VRM according to the present invention. Specifically two VRMs are interleaved together between a voltage source Vin and a load. The first VRM comprising Q1, Q2, and IL1, and a second, identical VRM comprising Q1', Q2', and IL2 is connected in parallel with the first VRM. FIG. 9B shows the current ripple canceling effect of the interleaved QSW VRM according to the present invention. It is noted that the current of the first inductor IL1 and the current from the second inductor IL2 mathematically cancel one another to an extent thereby producing a net output inductor Io having a reduced ripple.

Figure 10:
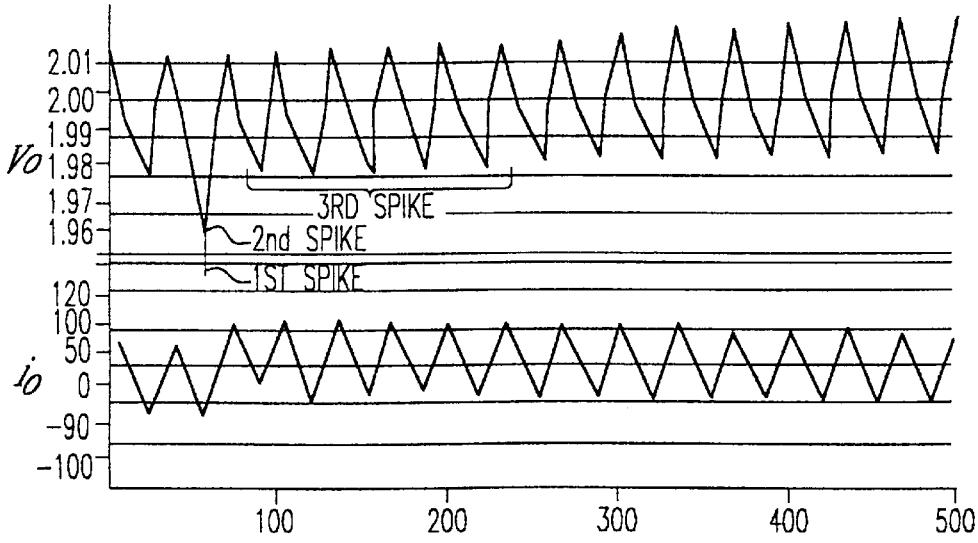
FIG. 10 is a graph showing the transient response of the QSW.

FIG. 10 shows the transient response of the QSW VRM. The small inductor makes the QSW VRM transient very fast. The longest and thinnest spike of Vo is the first spike. The following second deepest spike is the second spike. The third spike is not significant and the second spike is reduced.

Figure 11A:
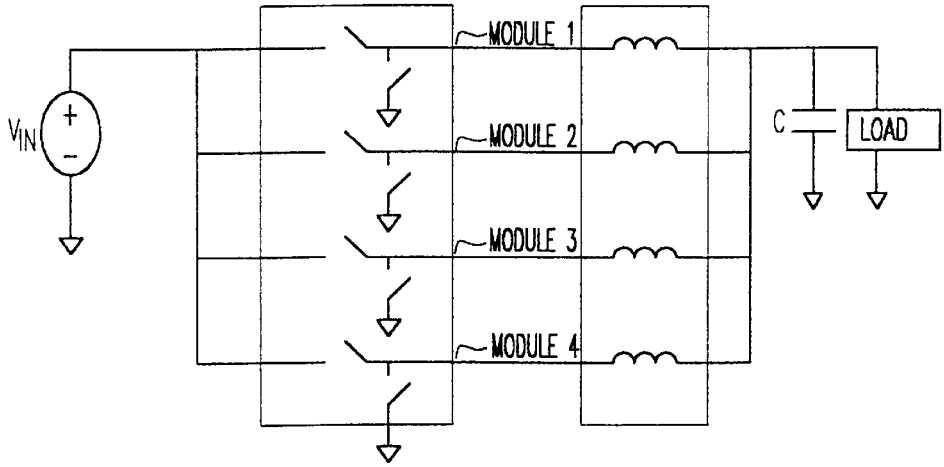
FIGS. 11A–B is a four-module interleaved QSW VRM and its transient response, respectively.
Figure 11B:
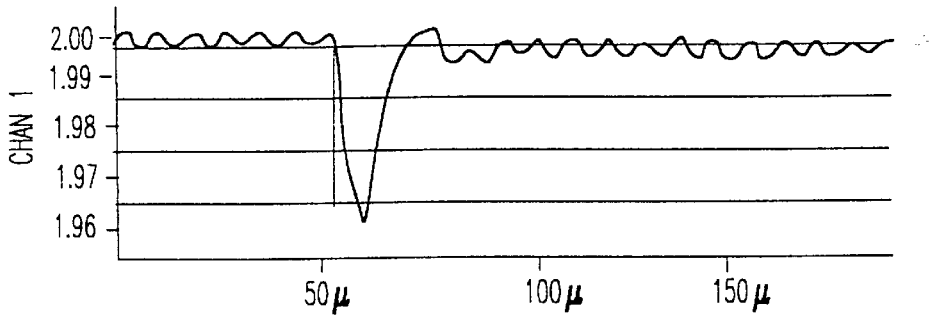
Figure 12:
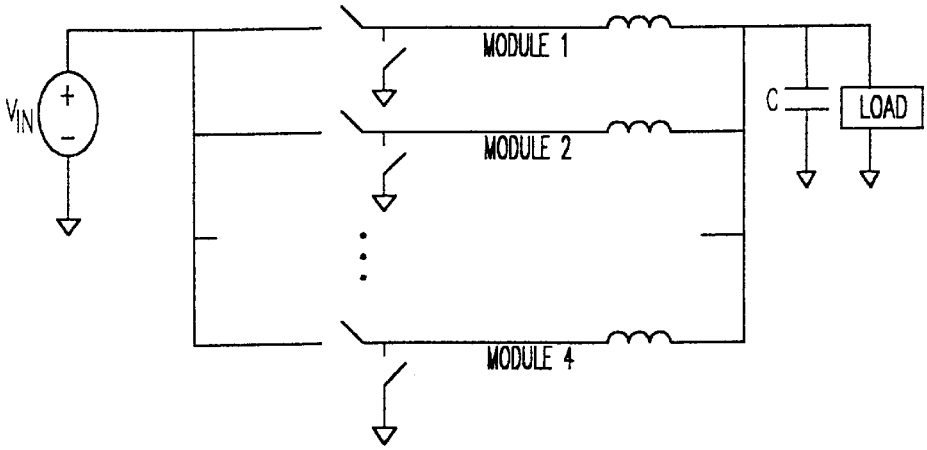
FIG. 12 is an n-module interleaved QSW VRM.

The concept of the interleaved VRMs can be extended to more than two VRMs. For example, FIG. 11A shows a 4-module interleaved QSW VRM and FIG. 11B shows its transient response with a load change from 1 A to 30 A in 1 $\mu$S The result shows that this technique can meet future transient requirements (voltage spike <2% output voltage) without a large steady state voltage ripple. Similarly, FIG. 12 shows n-module interleaved QSW VRM comprising n-modules interleaved together.

Figure 13:
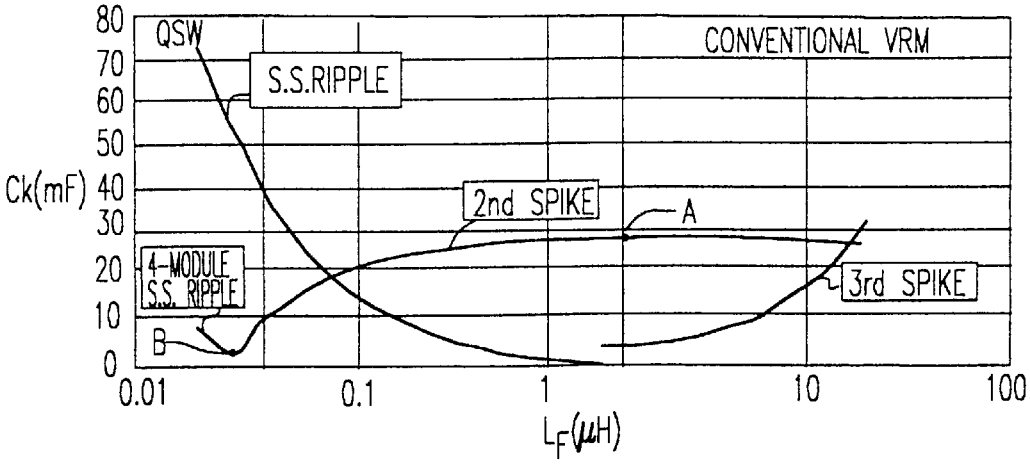
FIG. 13 is the output filter design comparison for QSW, conventional VRM and interleaved QSW.

FIG. 13 shows the output filter design comparison for an interleaved QSW, single QSW and conventional VRM. The result shows that the interleaved QSW topology needs much smaller capacitance to meet both the steady state and transient requirements. Compared with conventional VRMs, the capacitance needed in the interleaved QSW VRM is ten times smaller. In FIG. 13, the left area is QSW design area, and the right area is conventional VRM design area. For VRM design, all spikes should meet requirement. If we design the output capacitance according to the three spikes respectively, there are three curves in FIG. 13. The curve marked by S.S. ripple is the capacitance needed to keep the steady state ripple small enough to meet the requirement under different inductance. The curve marked by 2nd spike is the capacitance needed to keep the second spike small enough to meet the requirement. The curve marked by 3rd spike is the capacitance needed to keep the third spike small enough to meet the requirement. To design a conventional VRM, usually, point A is selected as design point. At point A, inductance is close to 2 uH, and capacitance is 30 mF. With this capacitance and inductance, all the spikes and ripples will meet the requirement. Referring still to FIG. 13, the curve under left corner, which is marked by 4-module S.S. ripple, is the capacitance needed in 4-module interleaved QSW VRM to keep the steady state ripple small enough to meet the requirement. To design a 4-module interleaved QSW VRM, point B is selected as design point. At point B, the inductance is 80 nH and the capacitance is 3 mF. With this capacitance and inductance, the 4-module interleaved QSW VRM can meet all the spikes and ripple requirements. Compared with conventional design, point A, the output capacitance needed for the 4-module interleaved QSW VRM is 10 times smaller.

Figure 14:
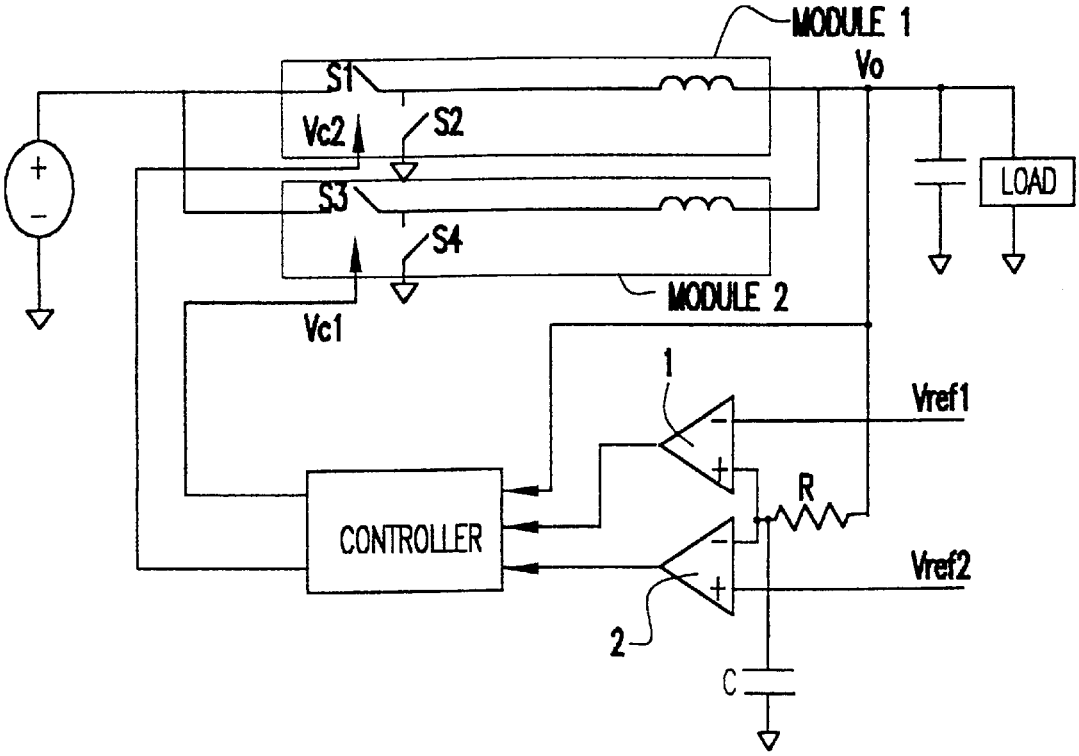
FIG. 14 is a diagram showing an interleaved QSW control strategy.

A control strategy for the interleaved QSW VRMs is shown in FIG. 14. When the VRM output voltage drops below a certain level, all the high side MOSFETs (S1 and S3) are turned on, and all the low side MOSFETs (S2 and S4) are turned off. When the VRM voltage drop is higher than a certain level, all the high side MOSFETs, S1 and S3, are turned off and all the low side MOSFETs, S2 and S4, are turned on. The resistor R and capacitor C form a low pass filter. If Vo is smaller than Vref1, comparator 1 gives a saturate signal to turn on both S1 and S3, and to turn off both S2 and S4. As a result, the input voltage is used to charge the output capacitor through the inductors. If Vo is larger than Vref2, comparator 2 gives another saturate signal to turn off both S1 and S3, and to turn on both S2 and S4. As a result, the output capacitor is discharged to ground through inductors.

Figure 15A:
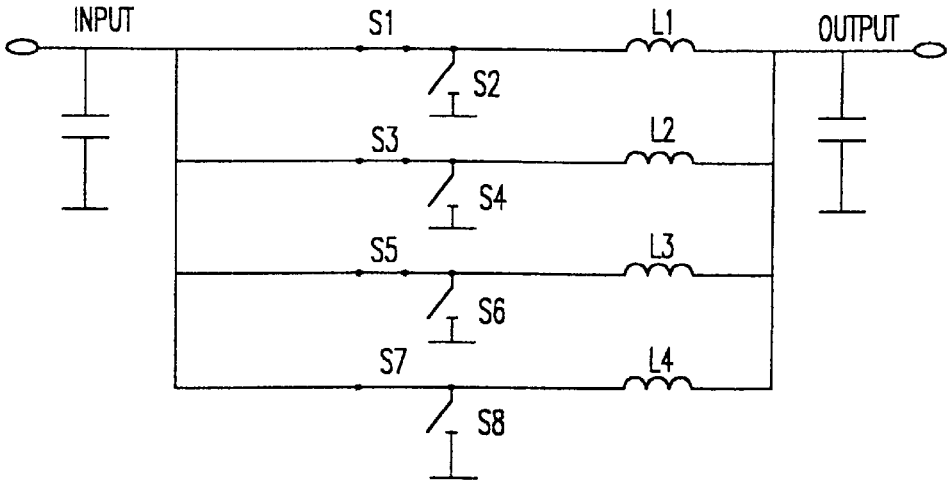
FIGS. 15A–B shows the operation of the interleaved QSW VRM for load step-up and step-down, respectively.
Figure 15B:
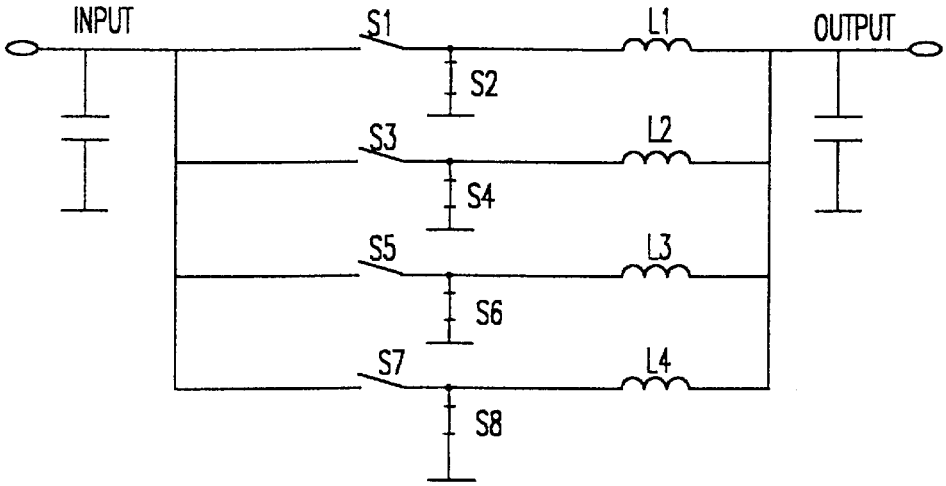

FIGS. 15A and 15B show the operation of the interleaved QSW VRM during the transient for load step-up and step-down, respectively. As shown in FIG. 15A, for load step-up, switches S2, S4, S6, and S8 are switched on an off. As shown in FIG. 15B for step down, switches S1, S3, S5, and S7 are switched. All the inductors L1–L4 operate in parallel during the transient. The inductance is equal to L/n. This small inductance increase the energy transfer speed. As a result, the transient is improved further.

Figure 16:
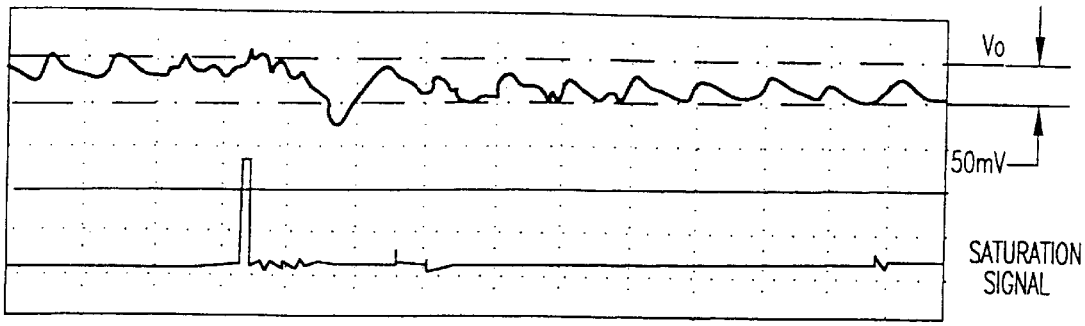
FIG. 16 shows the transient response of the 2-module interleaved QSW VRM.
Figure 17:
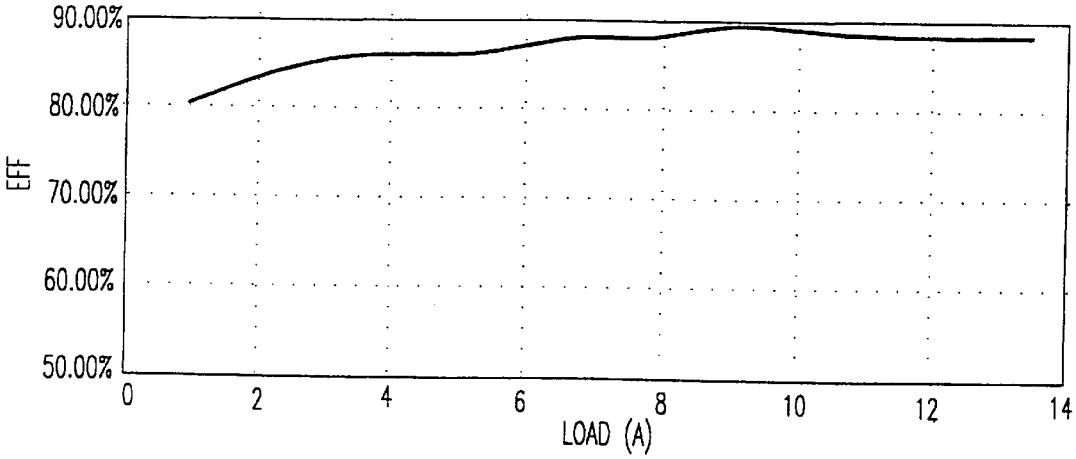
FIG. 17 is a graph showing the efficiency of the 2-module interleaved QSW VRM.

Table 2 shows the experiment design result. The design is for 13 A load, which change from 1A to 13 A or vice versa. Compared with today's design, which is also designed for 13 A. The inductance is 10 times smaller. The capacitance is 10 times smaller and the voltage spike is 3 times smaller. FIG. 16 shows the transient response of the two-module interleaved QSW VRM. FIG. 17 shows the efficiency.

TABLE 2

Design comparison of Interleaved QSW VRM and Conventional VRM

| | Interleaved QSW | Conventional VRM |
|---|---|---|
| Vin | 5 | 5 |
| Bulk capacitance | 520 uF | 7000 uF |
| Output Inductance | 320 nH (x2) | 3.8 uH |
| Transient voltage drop: | 50 mV | 150 mV |
| Vo @ load | 2 V @ 13 A | 2 V @ 13 A |

FIG. 16 shows the transient response of the two-module interleaved QSW VRM. The bottom curve in FIG. 16 is the saturate signal generated during transition. The top curve is the VRM output voltage, when load change from 1 A to 13 A.

FIG. 17 shows efficiency of the 2-module interleaved QSW VRM. At 1 A load, the VRM efficiency is 80%. At heavy load, the VRM efficiency is 87%.

The difficult in interleave technology is the current sensing and sharing control between the various modules. Conventional current sensing approaches are current transformer and sensing resistor. The current transformer is bulky and expensive. In low voltage and high current converters, adding a current transformer also reduce converter efficiency. The sensing resistor reduces converter efficiency significantly. On the other hand, high current, high power rating and high precision sensing resistors are expensive. Here, a novel current sensing and sharing control is disclosed, which is simple and inexpensive, and does not need a current transformer and current sensing resistor.

Figure 18:
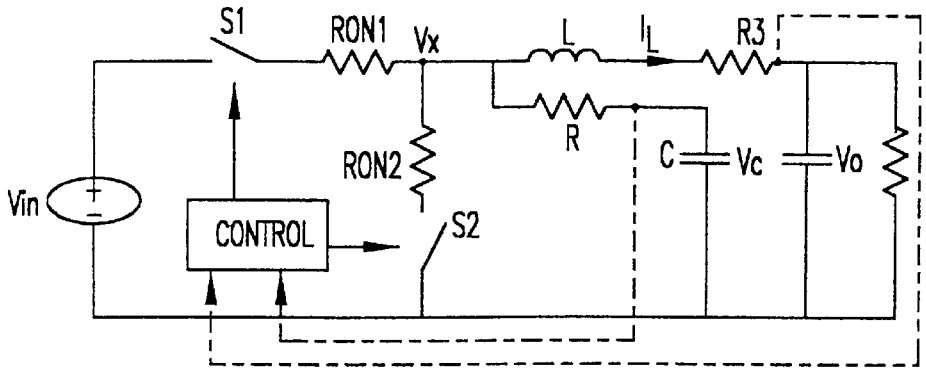
FIG. 18 shows a novel current sharing scheme for a VRM.

In FIG. 18, introduces an RC network to the buck converter. R3 is the sum of winding resistor and layout resistor. R3 is the inherent resistance of the winding resistor and layout resistor. The inherent resistance of a trace is called here layout resistor on a PCB board. The winding resistor is the inherent resistance of inductor winding. Ron1 and Ron2 are the parasitic resistance of the switched S1 and S2, respectively. Here, the voltage on C is used to emulate the inductor current $I_L$. The relationship between the capacitor voltage Vc and inductor current $I_L$ is shown in equation 2:

$$Vc=Vc(\text{avg})+\Delta Vc=Vo+I_L(\text{avg})R_3+\Delta I_L{}^*L/(R^*C) \quad (2)$$

If equation 3 can be satisfied:

$$R_3=L/(R^*C),\ (Vc-Vo)\ I_L \quad (3)$$

Then the inductor current can be emulated by capacitor voltage, which is shown in equation 4:

$$Vc\ (\text{peak})=Vo+k^*I_L(\text{peak}) \quad (4)$$

Where: k is constant and equal to $R_3$

When equation 3 is satisfied, capacitor voltage Vc can be used to emulate the instantaneous inductor current $I_L$. The difficulty of this approach is that precise R and C are required.

Another approach, which does not need precise R and C, is to sense the average inductor current. Equation 5 shows the relationship between the average capacitor voltage and average inductor current.

$$\langle Vc\rangle(\text{avg})=Vo+R^{3*}\langle I_L\rangle(\text{avg}) \quad (5)$$

With this approach, we can take the advantage of R3 to measure the average inductor current $\langle I_L\rangle$.

Figure 19:
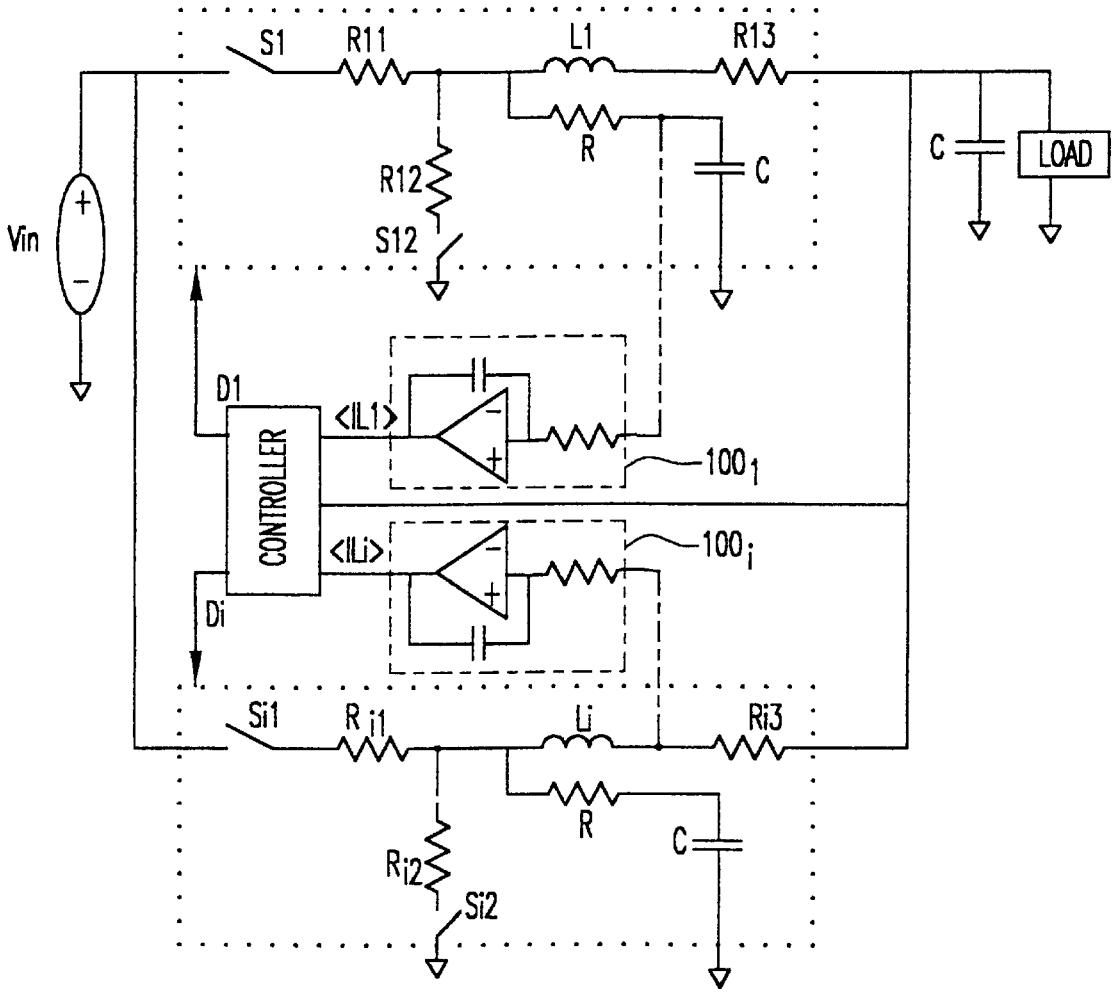
FIG. 19 shows a novel current sharing scheme for an interleaved QSW.
Figure 20:
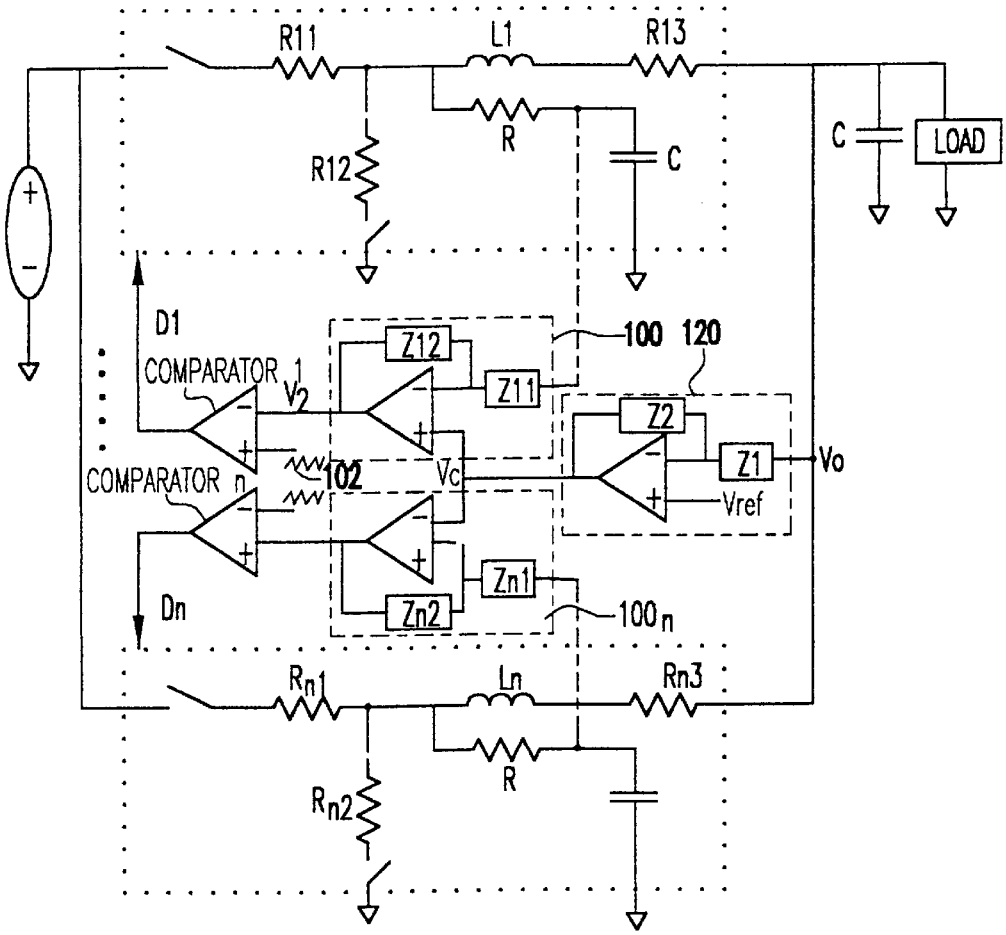
FIG. 20 shows a control diagram for the current sharing scheme.

FIG. 19 shows a novel current sharing approach, which controls the average inductor current. Here, the RC network in each module is connected between the inductor L and ground. The voltage across the capacitor C is passed into an integrator 100. The advantage of this approach is that precise R and C are not required, the difference of Ri1, Ri2 and Li has no effect on current sharing, and it utilizes the ratio of Ri3, not the absolute value, which is easy to control. The control design is very simply. Alternatively, the voltage at the inductor L may be fed directly into the integrator 100 eliminating the RC network altogether. The detail of the controller in FIG. 19 is explained in FIG. 20. The controller includes the voltage loop compensator 120. The integrators 100–100i are used to average current signal in each module. Each module has its own triangle signal 102. These triangle signals are interleaved such that they are out of phase for each module by 360°/n. For example, if two modules are interleaved, the triangle waves 102 for each module are out of phase by 180 degrees, three modules 120 degrees, four modules 90 degrees, and so on. In each module, the controller uses the voltage error signal Vc and current signal $V_L$ in that module to compare with its triangle signal. As a result, every module has generated therefor a duty cycle signal, D1–Di, and these signals are interleaved. There is one voltage loop compensator 120 for the whole circuit. The input to the inverting input of the operational amplifier in the compensator 120 is the output voltage signal Vo. Every module has its own current loop compensator comprising integrators 100–100i. The inverting inputs receives the current signal in each module. In each module, the signal generated by the current loop compensator is used to compare with its own triangle signal. As a result, the duty cycle signals D1–Di for each module are generated.

Figure 21:
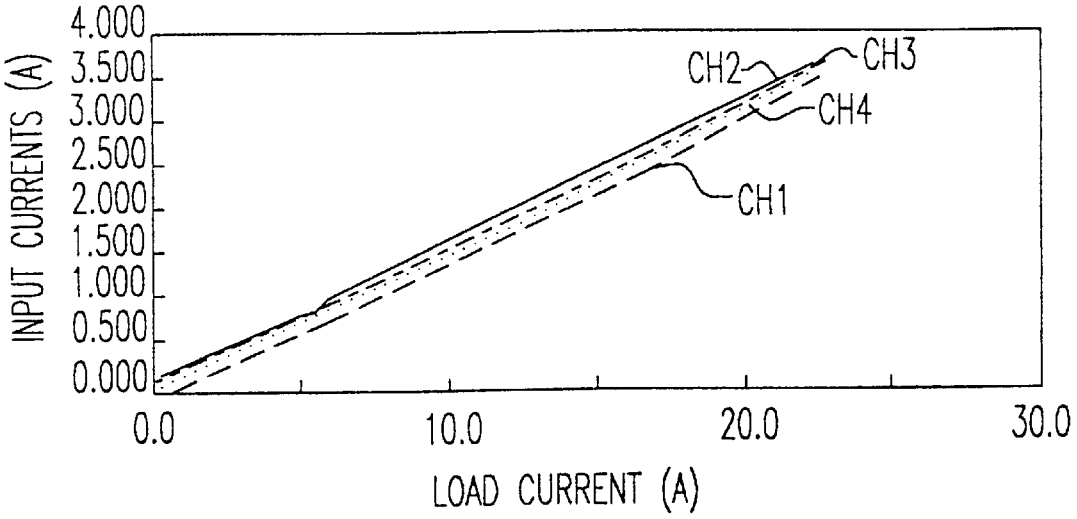
FIG. 21 is a graph showing the current sharing results of a 4-module interleaved QSW VRM.

FIG. 21 shows an experimental result in which this current sharing technology is used to control the current sharing in a four-module interleaved QSW VRM. Here, the input current is measured. When the load current increase from 0.5 A to 15 A, the difference in the input current is smaller than 40 mA.

Since the average current signal is used, the converter closed loop bandwidth is not affected. The converter, with this current sensing and current sharing approach, has fast transient response. FIG. 21 shows a transient response of a 4-module interleaved QSW, which uses this approach to control current sharing. When load changes from 0.5 A to 15 A (the load change slew rate is 3 OA/uS), the output voltage drop only 40 mV. The output capacitance is 1500 uF. If the select precise R and C (shown in FIG. 18), the voltage signal of C can be used for protection purpose.

When the power stage and the control has the same ground, the RC network in FIG. 18 is not necessary put in the power stage. The RC network can be put with the control together. When the current ripple is not large, the RC network is not necessary. Using an integrator to average the signal of Vx (shown in FIG. 18) directly, the average inductor current signal can be obtained. If the Ri3 (shown in FIG. 19) in every module has the same value, Zi1 (I=1,n) can use a capacitor. If all Ri3 are different, but its ratio is fixed, current loop Zi1 and Zi2 can be designed as a PI adjuster. The parameter for the compensator is decided by the ratio of Ri3.

Since this technology is used to measure inductor current, it can be used to any converters, where the inductor current signal is useful, like boost converter, forward converter in parallel, etc.

Figure 22:
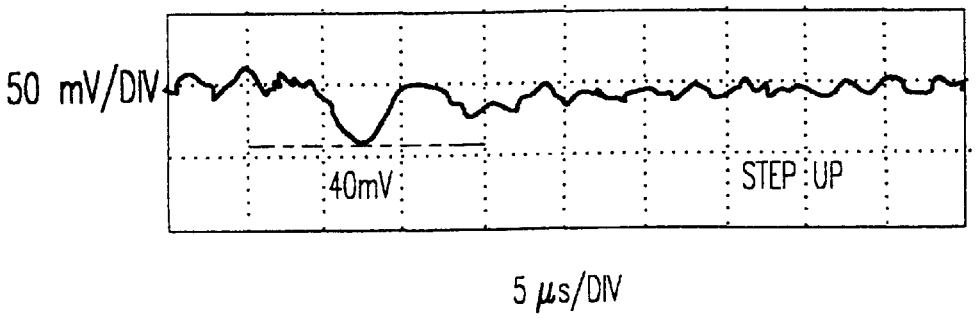
FIG. 22 is a graph showing the transient response of the 4-module interleaved QSW VRM.

FIG. 21 shows the current sharing results of 4-module interleaved QSW VRM. FIG. 22 shows the transient response of a 4-module interleaved QSW VRM.

While the invention has been described in terms of a single preferred embodiment, those skilled in the art will recognize that the invention can be practiced with modification within the spirit and scope of the appended claims.

We claim:

1. In a dc-dc voltage converter comprising n interleaved dc-dc converters, where n is an integer greater than or equal to 2, connected in parallel between a dc voltage source terminal and a load terminal, said dc-dc converters each comprising an inductor for delivering a current to said load terminal; a controller for controlling a switching network for connecting and disconnecting said inductor to one of said voltage source terminal and ground; and an output capacitor connected in parallel with said load terminal for supplying an output voltage signal, said controller comprising:

a first integrator circuit connected to said output capacitor for generating an integrated output voltage signal;

n second integrator circuits, each having an inverting input connected to said inductor of each of said n dc-dc converters, and a non-inverting input connected to receive said integrated output voltage signal; and n-comparators for outputting a duty cycle signal for said switching networks in each of said n dc-dc converters, each of said n-comparators for comparing an output signal from one of said n-second integrator circuits to a triangle wave; and a resistive capacitive (RC) network connected between said inductor and ground, and wherein said inverting input of each of said n second integrator circuits is connected to said inductor through said RC network.

2. A switchmode power converter, comprising a plurality of switching stages, each switching stage including a series coupled pair of MOS-gated switching elements including a high side switch and a low side switch coupled together at a common node, each switching stage being connectable from a voltage source to a ground potential;

a plurality of inductors coupled, at respective first ends, to the respective common nodes of the switching stages;

a shunt capacitor coupled from second ends of the plurality of inductors to the ground potential; and a controller connected between said shunt capacitor and said switching stages, said controller comprising:

a first comparator for comparing an output voltage across said shunt capacitor to a first reference voltage; and a second comparator for comparing said output voltage to a second reference voltage, wherein if said output voltage falls below said first reference voltage, said controller turns on said high side switches and turns off said low side switches; and if said output voltage rises above said second reference voltage, said controller turns off said high side switches and turns on said low side switches.

3. The switchmode power converter of claim 2, wherein each series coupled pair of MOS-gated switching elements includes:

at least one series MOS-gated switching element coupled in series with the respective inductor; and at least one MOS-gated switching element coupling the respective inductor to the ground potential.

4. The switchmode power converter of claim 3, wherein the control circuit provides the gate signals to the MOS-gated switching elements such that the at least one series MOS-gated switching element of each switching stage turns on and off at substantially different instants from one another.

5. The switchmode power converter of claim 3, wherein the control circuit provides the gate signals to the MOS-gated switching elements such that the at least one shunt MOS-gated switching element of each switching stage turns on and off at substantially different instants from one another.

6. The switchmode power converter of claim 3, wherein the control circuit provides the gate signals to the MOS-gated switching elements such that the at least one series MOS-gated switching element of each switching stage turns on and off at substantially the same instant.

7. The switchmode power converter of claim 2, wherein the MOS-gated switching elements are MOSFETs.

8. The switchmode power converter of claim 2, wherein the voltage source is a DC voltage source.

9. An interleaved dc-dc voltage converter for a voltage regulator module (VRM), comprising:

at least two dc-dc converters connected in parallel between a dc voltage source terminal and a load terminal, said dc-dc converters each comprising:

an inductor for delivering a current to said load terminal; and a switching network having a high side switch for connecting sa id inductor to said voltage source terminal and a low said switch for connecting said inductor to ground;

an output capacitor connected in parallel with said load terminal;

a controller connected between said output capacitor and said switching networks, said controller comprising:

a first comparator for comparing an output voltage across said output capacitor to a first reference voltage; and a second comparator for comparing said output voltage to a second reference voltage, wherein if said output voltage falls below said first reference voltage, said controller turns on said high side switches and turns off said low side switches; and if said output voltage rises above said second reference voltage, said controller turns off said high side switches and turns on said low side switches.

10. An interleaved dc-dc voltage converter for a voltage regulator module (VRM), as recited in claim 9 wherein said at least two dc-dc converters comprise buck converters.

11. An interleaved dc-dc voltage converter for a voltage regulator module (VRM), as recited in claim 9 further comprising a low pass filter connected between said output capacitor and said first comparator and said second comparator.

12. An interleaved dc-dc voltage converter for a voltage regulator module (VRM), comprising:

n dc-dc converters, where n is an integer greater than or equal to 2, connected in parallel between a dc voltage source terminal and a load terminal, said dc-dc converters each comprising:

an inductor for delivering a current to said load terminal; and a switching network for connecting and disconnecting said inductor to one of said voltage source terminal and ground;

an output capacitor connected in parallel with said load terminal for supplying an output voltage signal; and a controller for controlling said switching networks, said controller comprising:

a first integrator circuit connected to said output capacitor for generating an integrated output voltage signal;

n second integrator circuits, each having an inverting input connected to said inductor of each of said n dc-dc converters, and a non-inverting input connected to receive said integrated output voltage signal; and n-comparators for outputting a duty cycle signal for said switching networks in each of said n dc-dc converters, each of said n-comparators for comparing an output signal from one of said n-second integrator circuits to a triangle wave; and a resistive capacitive (RC) network connected between said inductor and ground, and wherein said inverting input of each of said n second integrator circuits is connected to said inductor through said RC network.

13. An interleaved dc-dc voltage converter for a voltage regulator module (VRM) as recited in claim 12 wherein said n dc-dc converters comprise buck converters.

14. An interleaved dc-dc voltage converter for a voltage regulator module (VRM) as recited in claim 12 wherein said triangle wave input to each of said n-comparators is out of phase by 360°/n degrees.

* * * * *